US008125338B2

(12) United States Patent
Li

(10) Patent No.: US 8,125,338 B2
(45) Date of Patent: Feb. 28, 2012

(54) ACOUSTO-MAGNETIC ANTI-THEFT ALARMING UNIT WITH MAGNETIC DETACHER

(75) Inventor: Lin Li, BeiLun (CN)

(73) Assignee: Ningbo Signatronic Technologies, Ltd., Ningbo, Beilun (CN)

( * ) Notice: Subject to any disclaimer, the term of this patent is extended or adjusted under 35 U.S.C. 154(b) by 463 days.

(21) Appl. No.: 12/491,215

(22) Filed: Jun. 24, 2009

(65) Prior Publication Data

US 2009/0322528 A1 Dec. 31, 2009

(30) Foreign Application Priority Data

Jun. 26, 2008 (CN) ..... 2008 1 0062642

(51) Int. Cl.
*G08B 13/14* (2006.01)

(52) U.S. Cl. ..... 340/568.1; 340/572.6; 340/572.1; 340/561; 340/567; 148/108; 148/121; 148/122

(58) Field of Classification Search ..... 340/568.1, 340/572.6, 572.1, 561, 567; 148/108, 120, 148/121, 122, 304, 310
See application file for complete search history.

(56) References Cited

U.S. PATENT DOCUMENTS 4,510,489 A * 4/1985 Anderson et al. ..... 340/572.1
6,359,563 B1 * 3/2002 Herzer ..... 340/572.6

* cited by examiner

*Primary Examiner* — Jennifer Mehmood
*Assistant Examiner* — Hongmin Fan
(74) *Attorney, Agent, or Firm* — Miller Law Group, PLLC

(57) ABSTRACT

An acousto-magnetic (AM) anti-theft alarming unit is designed for specific use in a hard tag anti-theft clamp which uses a magnetic detacher. The alarming unit includes a resonator housing defining a cavity in which is placed at least one resonator and a bias piece covered by a housing cover affixed to the resonator housing. The resonators are placed into the housing cavity in a vertically layered configuration. The bias piece is placed along the side of the resonators, as opposed to being beneath the resonators, as is conventional in the art. The bias piece is preferably made of a sintered rare-earth permanent magnet and has a high coercivity. Accordingly, this alarming unit has a strong resistance to demagnetization and a resistance to being shielded by metal. The bias piece has a strong anti-destruction ability, a simple structure and is easy to manufacture.

14 Claims, 4 Drawing Sheets

ACOUSTO-MAGNETIC ANTI-THEFT ALARMING UNIT WITH MAGNETIC DETACHER

FIELD OF THE INVENTION

The present relates generally to an anti-theft device, and, more particularly, to a type of acousto-magnetic (AM) anti-theft alarming unit used in a permanent AM clamp.

BACKGROUND OF THE INVENTION

Acousto-magnetic (AM) technology has been widely used in anti-theft system. AM systems are typically used in detection panels, deactivators, AM tags etc. The detection panels emit pulses at a certain frequency, excite the active AM tags and cause the AM tags to emit strong resonating signals, which can be detected by detection panels, and, therefore, set off the alarm. Currently, there are two types of the AM tags: anti-theft permanent AM clamps and anti-theft AM labels. Both types of AM tags use amorphous as the resonator(s), and crystalline magnetic materials as the bias.

Based on the detach methods to take pin out, AM clamps can be classified into two categories: mechanical detach and magnetic detach. Current AM clamps, such as Sensormatic Electronics Corporation (SEC) manufactured under the trademarks SuperTag® and UltraGator™, must use the non-magnetic method, namely mechanical (contact) detachers, because the strong magnetic field from the magnetic detachers will cause magnetized direction changes in the bonded ferrite magnet bias, which damage the AM alarming unit constructed from resonators and bonded ferrite magnet bias. The magnetic field from a rare earth permanent magnet, in a magnetic detacher to attract spring piece in a magnetic locker, can reach to about 4000-6000 Gauss, while current AM clamps such as manufactured by SEC under the trademarks "SuperTag" and "UltraGator" use bonded permanent magnet bias with coercivity range only in about 2000-3000 Oe. Such bias is easy to be re-magnetized to new directions by the strong and curvature magnetic field from magnetic detachers which are deviated from the original magnetic direction along the length dimension of the resonator(s). The result of the re-magnetization of the AM alarming unit is that the unit degraded from active to deactivated, which is a permanent damage to the hard tag. Thus, mechanical detachers have to be used for prior AM clamps.

Compared to non-contact magnetic detach, the mechanical detach process is more complicated, manufacture cost is higher, and the mechanical head is also easy to be damaged which results in higher maintenance costs. The mechanical detach has to be a contact method which is inconvenient for cashiers to operate. These disadvantages limit the further cost reductions, as well as limit market expansion of AM hard tags. Current AM alarm units use permanent magnetic materials, such as ferrite magnets, with a coercivity above 1000 A/m (125 Oe), with the resonators and bias pieces being stacked in different compartments. So far, only SEC can produce the qualified integrated AM unit while no other hard tag companies can make qualified resonators and bias. Therefore, these hard tag companies would have to purchase such alarming units first, then place the units into the hard tag shells to make hard tags. But, there is no such separated permanent AM alarming unit available in the market now. Consequently, some hard tag companies have to use an alternative way: to use disposable AM labels to act as permanent AM units to make hard tags. Current disposable labels use semi-hard magnetic material, that has direct current coercivity between 1000 A/m (12.5 Oe) and 10000 A/m (125 Oe), such as SEC manufactured DR labels. The original purpose for such disposable labels was to use it with active/deactivate functions. Deactivated labels will not set off the alarm at store exits. However, the hard tags made with disposable labels will have a fatal defect in that these kind of hard tags will become functionless when disposable labels are easily deactivated.

Known prior art AM labels, such as are disclosed in U.S. Pat. No. 6,359,563, are depicted in FIGS. 1 and 2 and include in an elongated plastic housing 101 and the housing cover 103, which is made of, from top to bottom, a cover film 105, double tape 106, semi-hard magnetic bias piece 104 and another piece of cover film all formed in a layered structure. Inside the housing, there is at least one or more resonator(s) 102 with the size matching the size of the house. The resonator(s) 102 has a bowed shape, while the bias piece 104 has a parallelogram shape or the shape of a parallelogram with corners cut. Prior AM labels use semi-hard materials to make the bias piece. If one has to use a DR label as the alarming unit to make permanent AM clamps, this AM clamp will become functionless because a magnet could change the DR performance or eliminate the effective magnetization of the AM label, causing a failure to alarm in the interrogation zone when the merchandises attached with such AM clamp are passing through the stores' gates.

SUMMARY OF THE INVENTION

It is an object of this invention to overcome the above mentioned technical difficulties, and provide an AM permanent alarm unit which has simple structure, thin profile, low cost, easy to process, very difficult to be demagnetized, difficult to be shield, stable in resonating frequency, being placed in various permanent AM clamps;

Another object of this invention is to provide a type of permanent AM clamps embedded with this invented alarming unit, which can use magnetic detachers to detach. The permanent AM clamps have stable and reliable performance, with excellent anti-disturbance ability. Furthermore, the manufacturing of such AM clamps are simple.

The technological problems in this invention are resolved through following technical routes: A type of the acousto-magnetic (AM) anti-theft alarming unit which can use magnetic detachers. The alarming unit includes a resonating housing, a bias piece, resonator(s) and housing cover, the resonators being placed into the housing. The cover and resonators are arranged in a layered structure. The bias piece is only placed along a single side of the resonator(s), the length dimension of the bias piece is same as the length dimension of the resonators. The bias piece is made of a sintered rare-earth permanent magnet having a coercivity along the length dimension of about 7000 Oe.

The bias piece is a strong permanent magnet with very high coercivity. The magnet inside a magnetic detacher creates a magnetic field of 4000-6000 Gs, which will not able to demagnetize, or cause the deviation of the magnetization originally set along the resonator(s) length dimension of the bias piece herein. In prior arts, the bias and resonators are arranged in a layered structure, which induces the strong "clamping" effects to the resonators, resulting in the reduction of resonating amplitude of the resonator(s). A rare earth permanent magnet bias piece will cause strong clamping. When we place a thin bar only in single side of the resonator (s), with the bias length dimension being essentially parallel to the resonator(s) length dimension, and essentially on the same plane of resonator(s), the free vibration of resonator(s) along the length direction is essentially not affected, even if the resonator(s) will be attracted to this thin bar side. Furthermore, the resonators do not have high frictions during resonating, unlike the resonators arranged as layered structured related to bias piece placed underneath. Instead, almost no friction exists between the resonators in this invented structure.

Therefore, this invention produces a quite high resonating amplitude, and the resonating signal is not reduced. This invention changes the shape of the bias piece from flat to a long thin bar, and changes the bias piece position from underneath the resonator(s) to being placed only on a single side of the resonators, thereby greatly reducing the strong "clamping" effect previously caused by strong magnetic bias piece placed in layered structure. Thus, we solve a very difficult previous problem of stronger magnets bias causing a stronger clamping effect. And we can feel free to use the strongest permanent magnets, such as sintered rare earth permanent magnets, to make bias piece in order to make permanent AM clamps which can use magnetic detachers.

As preferred, the bias thin bar length is 10 times or higher than the diameter or maximum width dimension of the long thin bias piece. The cross-sectional shape of the bias piece is round or rectangular or square. The resonator(s) is(are) one or more; Rare earth permanent magnets are brittle, difficult to produce by cold forming, and, therefore, are not suitable for making the bias piece as a thin flat form. However, the bar magnet configuration having a round, rectangular or square cross-sectional shape is easier to manufacture, avoiding this disadvantage of rare earth permanent magnets. The resonator is not limited to one piece, but can be provided as two or more to enhance signal strength according to needs.

Preferably, the bias piece is made of sintered NdFeB or sintered Sm—Co rare earth permanent magnets. NdFeB is known to have the highest energy product and has an excellent performance/price ratio, allowing the alarming unit to be miniaturized and lighter in weight. Now shoplifters can not defeat an AM anti-theft clamp anymore, even if they utilize a strong NdFeB or Sm—Co rare earth magnet, they will fail to damage the bias piece in the invented alarming unit.

As preferred, the resonating housing is rectangular in shape, and has a cavity surrounded by a flange, with the housing cover sized to match the cavity and flange. The cover includes in cover film, with double glue tape placed on the lower surface edge of the cover film. The size of the double glue tape covers the area of house aperture flange. The housing cover is slightly bigger than house cavity, so that the double tape can affix the housing flange and the cover film together. Thus, the alarming unit can be placed inside the AM clamp conveniently. Meanwhile, the alarming unit can be used independently, to extend its applications. For example, the housing and the housing cover can be formed together, to make it easier for placing the alarming unit into AM clamp as a whole unit.

As preferred, the resonators can be 2 or 3, which have better resonating performance with higher resonating amplitude.

The bias piece can be placed either inside or outside the resonating housing, as long as the bias piece is placed only at single side of resonator(s). According to the principles of the instant invention, the resonating signal is least affected by the bias piece, with stronger resonating amplitude.

The bias piece can also be directly molded into the resonating housing wall by plastic injection molding, which merges the processes of making resonating housing and fixing the bias piece, resulted in reduced manufacture steps.

A type of the acousto-magnetic (AM) anti-theft clamp has an upper clamp cover and a lower clamp cover. Between the upper clamp cover and the lower clamp cover, there is a clamp cavity and a pin-locking device. The alarm unit, which includes within the resonating housing, a bias piece, at least one resonator and the housing cover is enclosed within the clamp cavity. The resonator(s) is(are) placed inside the house in a layered configuration with the bias piece being placed only at single side of the resonator(s), the length dimension of the bias piece being the same as the length dimension of the resonator(s), the bias piece being made of a sintered rare-earth permanent magnet with the coercivity along the length dimension being greater than 7000 Oe.

As preferred, the bias piece used in above mentioned acousto-magnetic (AM) anti-theft clamp is a thin bar with round or rectangular or square cross-sections. The bias piece is fixed inside or outside resonating house or within the resonating house wall by plastic injection molding. The resonator can be one piece or more than one.

Since the instant AM anti-theft alarm unit has the advantage of not being damaged by strong magnetic field and the resonating amplitude is not affected by strong magnetic field, this alarming unit is not only suitable for AM clamps using mechanical detachers, but also suitable for AM clamps using magnetic detachers. Compared to mechanical detachers, the magnetic detachers are structurally simpler, lower in manufacturing costs, easier to detach since it is contact-less, which greatly reduces the storage costs for using various AM clamps, widening the application scopes, and lowers the cost for end users in purchasing new equipment and their maintenance costs. Furthermore, this invention not only provides an AM alarming for making various AM clamps, but also can be used independently as a permanent AM label.

AM clamps using magnetic detachers are very stable and reliable in alarming performance, have excellent anti-disturbance ability, and the manufacture process is simpler.

An acousto-magnetic (AM) anti-theft alarming unit is designed for specific use in a hard tag anti-theft clamp which uses a magnetic detacher. The alarming unit includes a resonator housing defining a cavity in which is placed at least one resonator and a bias piece covered by a housing cover affixed to the resonator housing. The resonators are placed into the housing cavity in a vertically layered configuration. The bias piece is placed along the side of the resonators, as opposed to being beneath the resonators, as is conventional in the art. The bias piece is preferably made of a sintered rare-earth permanent magnet and has a high coercivity. Accordingly, this alarming unit has a strong resistance to demagnetization and a resistance to being shielded by metal. The bias piece has a strong anti-destruction ability, a simple structure and is easy to manufacture. The AM anti-theft clamps enclosing the instant AM alarming unit can use a magnetic detacher and exhibits a stable and reliable performance.

DETAILED DESCRIPTION OF THE PREFERRED EMBODIMENT

Figure 1:
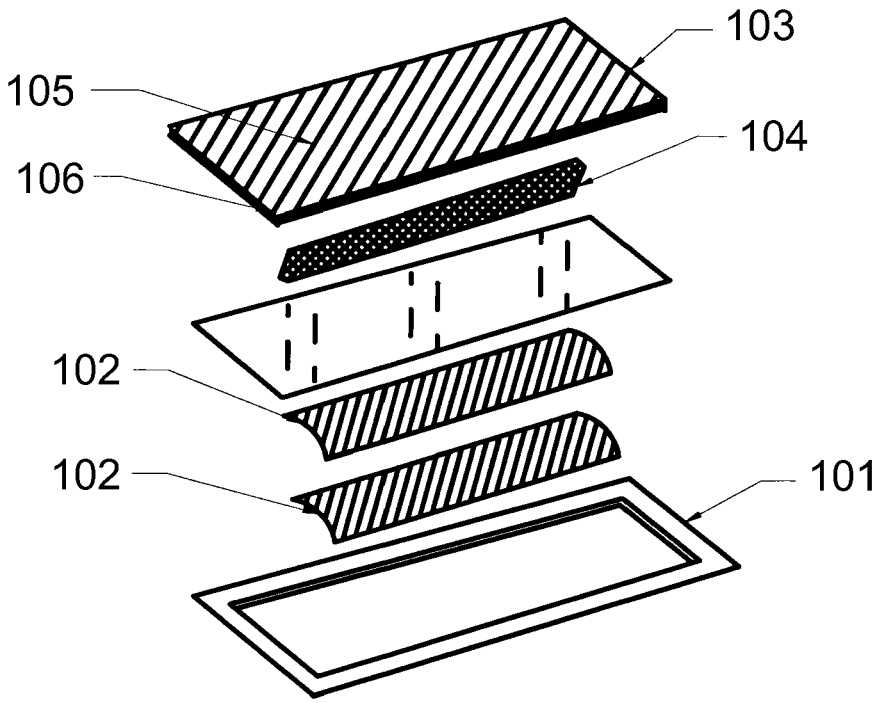
FIG. 1 is an exploded view of a type of prior art structure of an AM label.
Figure 2:
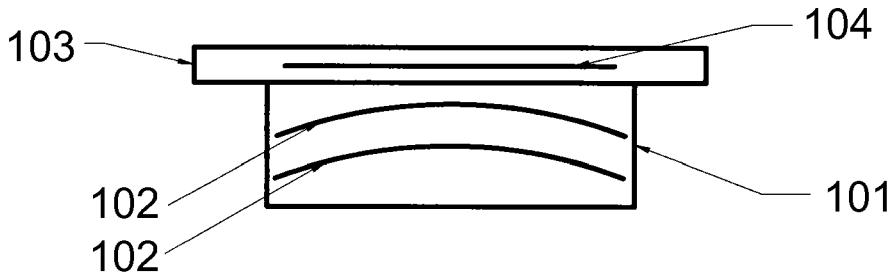
FIG. 2 is the cross section of prior art structure of an AM label shown in FIG. 1.
Figure 3:
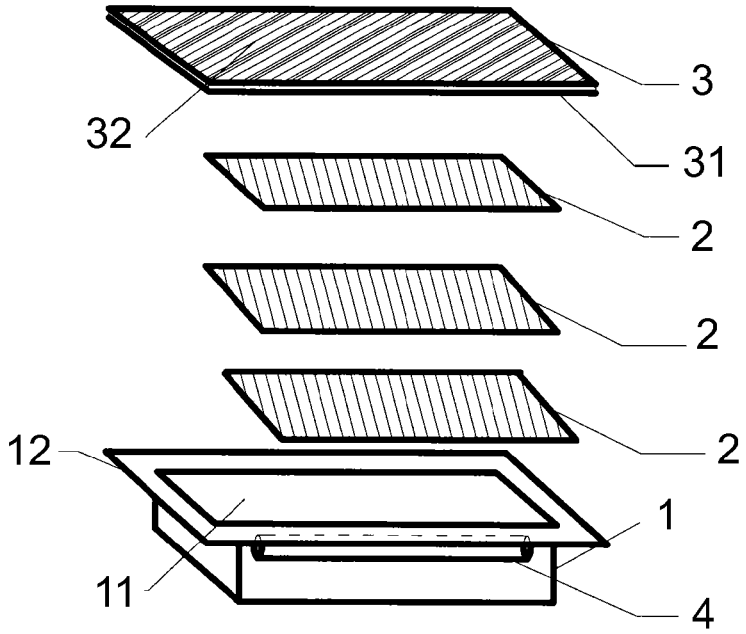
FIG. 3 is an exploded view of a first embodiment of a AM anti-theft alarming unit incorporating the principles of the instant invention.
Figure 4:
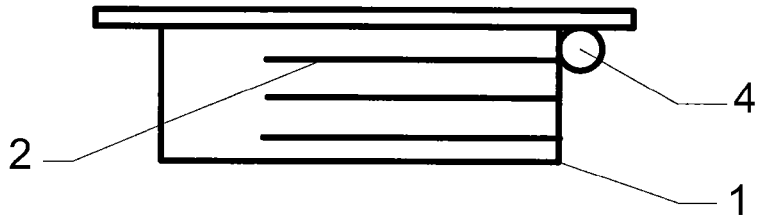
FIG. 4 is a cross-sectional view of the anti-theft alarming unit depicted in FIG. 3.

Referring now to FIGS. 3 and 4, a first embodiment of the acouto-magnetic anti-theft alarming unit incorporating the principles of the instant invention can best be seen. The alarming unit depicted in FIGS. 3 and 4 can be placed inside an AM clamp that can use a magnetic detacher to take the pin out, includes a housing (1) preferably made of a plastic material formed in a rectangular shape. A cavity (11) is defined in the housing (1) where three essentially identical resonators (2) are flatly laid inside. The resonators (2) are smaller than the cavity (11) in size, and are preferably rectangular shape, with the length dimension being substantially the same as the length dimension of the housing (1).

A flange (12) is formed around the perimeter border of the resonator housing (1) with the cover (3) being sized to mate with the flange (12) around the housing (1). The cover (3) includes a cover film (32) and double glue tape (31), which is placed on the lower surface edge of the cover film (32) so that the double glue tape (31) is able to secure the cover film (32) to the flange (12) to glue the housing (1) and the cover (3) together. Of course there are other methods to join the housing (1) and the cover (3) together. The cover (3) and the resonator (2) are arranged in a layered structure or configuration. At one side of the housing outside wall, a thin round bar bias piece (4) with a diameter dimension approximately 0.8-1.5 mm and a length dimension approximately 15-35 mm is placed. The bias piece length dimension is essentially same as length direction of the resonator (2). The bias piece length is over 10 times of the diameter.

The bias piece (4) is preferably made of sintered NdFeB or Sm—Co rare earth permanent magnets with coercivity greater than 7000 Oe. Such high coercivity ensures that the bias piece will not be re-magnetized by the strong magnets found in the magnetic detachers, and further to avoid this alarming unit being damaged. NdFeB is the strongest magnet family so far. Sintered NdFeB is made from mixing alloy powders of the Nd rare earth and transition metal Fe, pressing the powders into green then sintered to make dense magnets via powder metallurgy, and being magnetized by very strong pulse magnetic field to make an active magnet. Sintering applies heat below the melting point of the alloy powders to increase the strength of the powder unit via metallurgical joining process between fine particles. The thin and long bar sintered NdFeB or Sm—Co rare earth magnet bias pieces can prevent shoplifters from attempting to use a strong magnet to damage invented AM alarming unit.

Detailed experiment data can be seen in table I. From table I, we can see that bias piece made with bonded ferrite, FeCrCo will be damaged by the strong magnets due to their low coercivity. Although isotropic bonded NdFeB has quite high intrinsic coercivity Hci around 9000-14000 Oe, it's demagnetization curve squareness is not high which leads to lower coercivity Hc down to 6000-7000 Oe. Therefore, the bonded NdFeB biased AM label will still be easily damaged by a sintered NdFeB magnet, which will normally have a surface field strength of about 4000-6000 Gs. However, the sintered NdFeB and SmCo has a process step to align fine powders in high magnetic field and compression aligned powders to make green body with high anisotropy, then further sintering makes a magnet with higher density and higher anisotropy. The bias piece in this invention utilizes such thin bar magnet with easy axis along length direction. Thus, said bias piece has very high coercivity Hc and is difficult to be re-magnetized to other directions. This characteristic ensures the AM alarm unit in this invention will be non-destructible by strong magnets.

We can also see that when such strong sintered NdFeB or SmCo magnet bias piece is placed on the bottom of the resonators, as is known conventionally, the bias piece will cause strong damping to resonating, thereby resulting in significantly degraded alarming distance (even if such AM alarming unit will not be damaged by strong magnets). Contrary to the conventional notion, only one bias thin bar magnet needs to be set on single side of the resonators. Thus, the strong attractions from the magnet bias piece only attract one side of the resonators with the other ends still being free. The data from table I proves that this kind of bias arrangement made new AM anti-theft alarming unit with almost no damping to resonating, maintaining high resonating amplitude, and long alarming distance, meanwhile the alarming unit will not be damaged by a strong magnet.

TABLE I

The effect from the permanent magnet bias materials and their positions to acousto-magnetic alarming unit performance

| Permanent bias piece of AM alarm units | | | | Alarming distance after initial pulse magnetization (cm) | | Alarming distance after a strong magnet damage ** (cm) | |
|---|---|---|---|---|---|---|---|
| Bias Magnet type | Hc (Oe) | Size (mm) | Position *** | Direction 1 * | Direction 2 | Direction 1 | Direction 2 |
| Bonded ferrite | 2000 | 1.5 × 6 × 20 | bottom | 28 | 27 | 12 | 8 |
| FeCrCo | 550 | 0.1 × 6 × 25 | bottom | 29 | 27 | 5 | 0 |
| Bonded NdFeB | 6600 | 1 × 6 × 20 | bottom | 28 | 27 | 20 | 23 |
| Sintered NdFeB | 7500 | Dia 0.8 × 15 | bottom | 23 | 20 | 22 | 23 |
| Sintered NdFeB | 7500 | Dia 0.8 × 15 | single side | 27 | 29 | 28 | 29 |
| Sintered NdFeB | 7500 | Dia 0.8 × 15 | bottom | 20 | 25 | 22 | 25 |
| Sintered NdFeB | 7500 | Dia 0.8 × 15 | single side | 28 | 29 | 29 | 28 |
| Sintered | 10000 | 0.8 × 0.8 × 25 | bottom | 18 | 20 | 19 | 20 |

TABLE I-continued

The effect from the permanent magnet bias materials and their positions to acousto-magnetic alarming unit performance

| Permanent bias piece of AM alarm units | | | | Alarming distance after initial pulse magnetization (cm) | | Alarming distance after a strong magnet damage ** (cm) | |
|---|---|---|---|---|---|---|---|
| Bias Magnet type | Hc (Oe) | Size (mm) | Position *** | Direction 1 * | Direction 2 | Direction 1 | Direction 2 |
| NdFeB Sintered | 10000 | 0.8 × 0.8 × 25 | single side | 27 | 29 | 28 | 28 |
| NdFeB Sintered | 8000 | 1.5 × 1.2 × 35 | bottom | 15 | 18 | 17 | 16 |
| SmCo5 Sintered | 8000 | 1.5 × 1.2 × 35 | single side | 25 | 27 | 26 | 27 |

* The alarming distance test direction: Use the "Double Checker" made by Sensormatic Electronics Corporation, the longest alarming distance when label is vertical to the double checker surface plane. Direction 2 is reverse end position of direction 1.
** A strong magnet damage: use a very strong sintered NdFeB with energy product 40 MGOe, diameter 15 mm, vertically touch the AM unit (vertical to length direction) then pull away.
*** "bottom"means the bias piece is placed on the resonators' bottom in layered structure. "Single side" means the thin bar bias piece is placed at single side of resonators, essentially on same plane of the resonators, the length direction is same as resonators' length direction.

Figure 5:
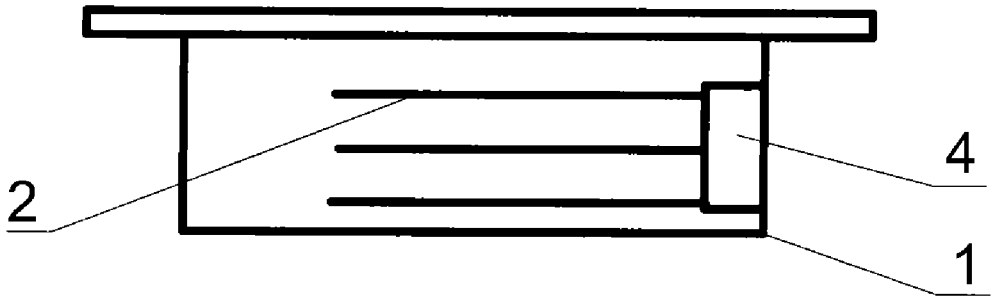
FIG. 5 is a cross-sectional view of a second embodiment of the instant invention.

Referring now to FIG. 5, an alternative embodiment of the instant invention can best be seen. The bias piece (4) in this embodiment is formed as a thin bar with a rectangular cross section and is placed in one internal side of the resonator housing (1). The other components in the alarming unit are arranged the same as described above with respect to the first embodiment shown in FIGS. 3 and 4. Although the cross section of the thin bar bias piece (4) differs from that depicted in FIGS. 3 and 4, the bias piece is still quite easy to make, still overcame the disadvantages from brittleness of the permanent magnetic materials. The bias piece is placed along the side of the resonator length dimension. Although the resonators (2) will be attracted to this single (bias) side, the two ends of the resonator along the length direction can still be free to vibrate, so that the resonating amplitude is not reduced and ensure the strong resonating signal is generated. The detailed data is listed in Table I.

Figure 6:
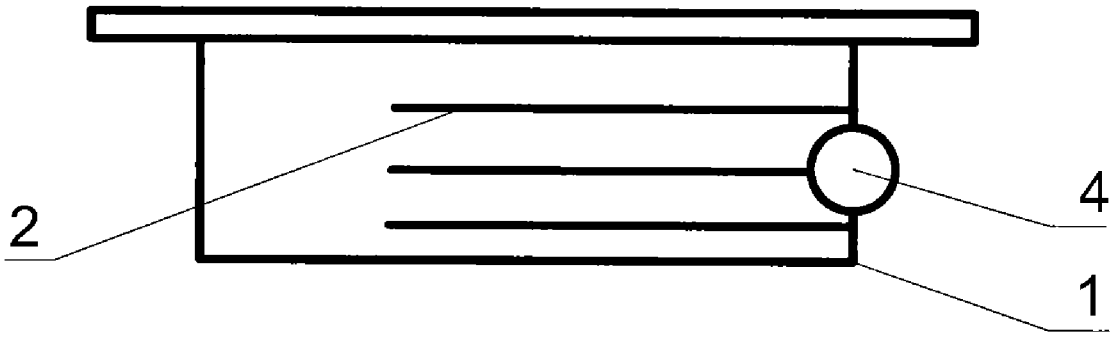
FIG. 6 is a cross-sectional view of a third embodiment of the instant invention.

Referring now to FIG. 6, a second alternative embodiment of the instant invention can best be seen. The bias piece (4) is molded in one side wall of the resonator housing (1) with the length dimension of the bias piece being substantially the same as the length dimension of the resonators. The other components of the alarming unit are arranged the same as described above with respect to the embodiment shown in FIGS. 3 and 4. When making the resonator housing (1), the bias piece (4) is molded inside the side wall of the housing (1), making the bias piece (4) an integrated part of the housing (1), thus simplifying the manufacturing processes. The bias piece (4) performance is substantially the same as in the first and second embodiments shown in FIGS. 3-5.

Figure 7:
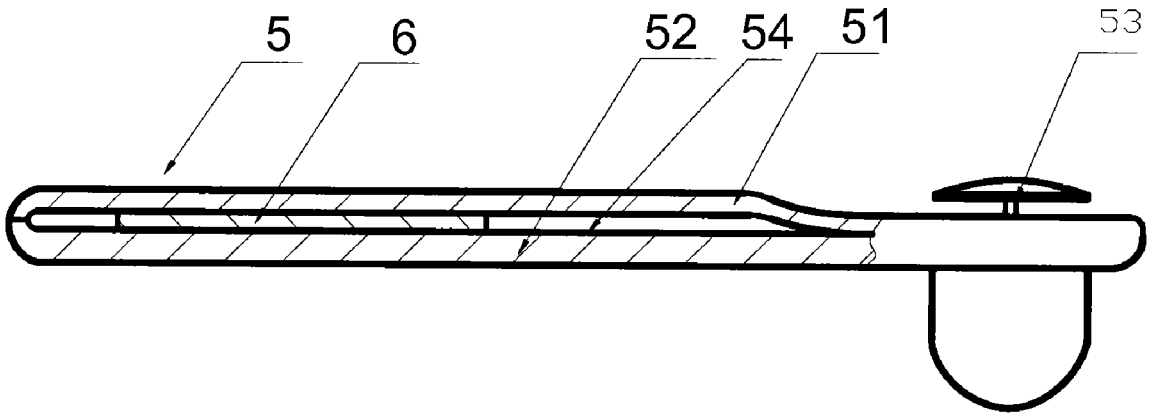
FIG. 7 is the schematic partial cross-sectional view of an AM clamp, which can use a magnetic detacher, according to the principles of the instant invention.

An acousto-magnetic (AM) anti-theft clamp incorporating the principles of the instant invention is best seen in FIG. 7. The anti-theft clamp includes an upper clamp cover (51) and a lower clamp cover (52). The alarm unit (6) is enclosed inside a clamp cavity (54) between the upper clamp cover (51) and the lower clamp cover (52). Through high frequency welding, the border of the upper clamp cover (52) and the lower clamp cover (51) are joined together. A pin lock device (53) is provided to lock a pin that is attached to merchandise to be protected, which locks the merchandise to the AM clamp. When the AM clamp is put over the magnetic detacher, the magnetic lock is open to release the pin, the AM clamp can then be safely detached from the merchandise. The alarming unit (6) can be installed into the AM clamp (5) as an integrated unit, which also allows the alarming unit (6) to be taken out or replaces as a whole.

The instant invention not only provides alarming units for making various AM anti-theft clamps, but also allows the unit to be used independently as a permanent AM anti-theft label.

The invention claimed is:

1. An acousto-magnetic anti-theft alarming unit for use with magnetic detachers, comprising:

a housing defining a resonating cavity;

a resonator positioned within said resonating cavity and having a layered structure with a first length dimension;

a bias piece constructed of a sintered rare-earth permanent magnet having a coercivity greater than 7000 Oe along said first length dimension of said resonator and being placed on a single side of said resonator, said bias piece having a second length dimension being substantially equal to said first dimension a top cover affixed to said housing to seal said resonator within said housing.

2. The alarming unit of claim 1 wherein said bias piece is a thin bar having a geometric cross-sectional configuration that is round or rectangular in shape, said resonator having multiple pieces.

3. The alarming unit of claim 1 wherein said bias piece is constructed of sintered NdFeB or Sm—Co rare earth permanent magnets.

4. The alarming unit of claim 1 wherein said housing is rectangular in shape with an aperture bordered by a flange, a cover member having a size mating to said aperture and flange, said cover member including a cover film with adhesive on one side thereof for engagement with said flange.

5. The alarming unit of claim 1 wherein said resonator has three or less pieces.

6. The alarming unit of claim 5 wherein said bias piece is mounted externally of said housing.

7. The alarming unit of claim 5 wherein said bias piece is mounted internally of said housing.

8. The alarming unit of claim 5 wherein said bias piece is incorporated into the structure of said housing by injection molding said housing around said bias piece.

9. An acousto-magnetic anti-theft clamp having an upper clamp cover and a lower clamp cover defining a clamp cavity therebetween, a pin lock device, and an alarm component, comprising:

a resonator housing positioned within said clamp cavity;

at least two resonators located within said housing in a layered structure, said resonators having a first length dimension;

a bias piece positioned on one side of said resonators and having a second length dimension substantially equal to said first length dimension, said bias piece being formed from a sintered rare-earth permanent magnet having a coercivity along said second length dimension greater than 7000 Oe; and a cover affixed to said housing.

10. The anti-theft clamp of claim 9 wherein said bias piece is mounted externally of said housing.

11. The anti-theft clamp of claim 9 wherein said bias piece is mounted internally of said housing.

12. The anti-theft clamp of claim 9 wherein said bias piece is incorporated into said housing by injection molding said housing around said bias piece.

13. The anti-theft clamp of claim 9 wherein said bias piece is formed as a thin bar having a rectangular cross-sectional shape.

14. The anti-theft clamp of claim 9 wherein said bias piece is formed with a round cross-sectional shape.

* * * * *